US010167579B2

(12) United States Patent
Kilickan et al.

(10) Patent No.: US 10,167,579 B2
(45) Date of Patent: Jan. 1, 2019

(54) FLEECE FABRIC AND METHOD FOR PRODUCING THE SAME

(71) Applicant: Sanko Tekstil Isletmeleri San. Ve Tic. A.S., Inegol-Bursa (TR)

(72) Inventors: Tuncay Kilickan, Inegol-Bursa (TR); Ertug Erkus, Inegol-Bursa (TR); Erdogan Baris Ozden, Inegol-Bursa (TR)

(73) Assignee: Sanko Tekstil Isletmeleri San. Ve Tic A.S., Inegol-Bursa (TR)

( * ) Notice: Subject to any disclaimer, the term of this patent is extended or adjusted under 35 U.S.C. 154(b) by 143 days.

(21) Appl. No.: 15/425,112

(22) Filed: Feb. 6, 2017

(65) Prior Publication Data

US 2017/0226668 A1 Aug. 10, 2017

(30) Foreign Application Priority Data

Feb. 10, 2016 (EP) ..... 16155105

(51) Int. Cl.
*D03D 27/02* (2006.01)
*D03D 3/08* (2006.01)
(Continued)

(52) U.S. Cl.
CPC ..... *D03D 3/08* (2013.01); *D03D 13/004* (2013.01); *D03D 15/0027* (2013.01);
(Continued)

(58) Field of Classification Search
CPC ..... D03D 27/02; D03D 11/02; D03D 13/004; D03D 15/00; D03D 15/0083; D03D 15/04; D03D 27/00; D03D 1/00
See application file for complete search history.

(56) References Cited

U.S. PATENT DOCUMENTS 4,390,572 A * 6/1983 Okamoto ..... D03D 15/00 428/15
5,701,643 A * 12/1997 Fleissner ..... D04H 18/04 28/105
(Continued)

FOREIGN PATENT DOCUMENTS

CN 102834557 12/2012
EP 1925702 5/2008
(Continued)

OTHER PUBLICATIONS

European Search Report of priority EP application 16155105.6 dated Jul. 22, 2016.
(Continued)

*Primary Examiner* — Bobby Muromoto, Jr.
(74) *Attorney, Agent, or Firm* — Silvia Salvadori

(57) ABSTRACT

A fabric having a first side and a second side and comprising weft yarns and warp yarns woven together in pattern. At least some of the weft, or warp, yarns float over a number of warp yarns, or weft yarns, and below a number of warp yarns, or weft yarns, to provide weft, or warp, over portions on the first side and under portions on the second side. The under portions and/or over portions of the yarns form loops. At least some of the yarns that form the loops are conjugate yarns comprising a plurality of filaments that are separable, i.e., splittable into sub-filaments. The loops of the conjugate yarns extend for a length of at least three adjacent warp, or weft, yarns.

21 Claims, 7 Drawing Sheets

(51) Int. Cl.

| | |
|---|---|
| ***D03D 13/00*** | (2006.01) |
| ***D03D 15/00*** | (2006.01) |
| ***D03D 15/08*** | (2006.01) |
| *D03D 25/00* | (2006.01) |

(52) U.S. Cl.
CPC ..... *D03D 15/0061* (2013.01); *D03D 15/08* (2013.01); *D03D 27/02* (2013.01); *D10B 2201/02* (2013.01); *D10B 2331/02* (2013.01); *D10B 2331/04* (2013.01); *D10B 2331/10* (2013.01)

(56) References Cited

U.S. PATENT DOCUMENTS

| | | | | |
|---|---|---|---|---|
| 6,079,235 | A * | 6/2000 | Schmidt | D04B 1/126 66/136 |
| 7,337,810 | B2 * | 3/2008 | Orr | D04H 3/05 139/408 |
| 2006/0228970 | A1 * | 10/2006 | Orr | D04H 3/05 442/329 |
| 2016/0032501 | A1 * | 2/2016 | Baychar | D04B 1/16 442/194 |
| 2017/0226668 | A1 * | 8/2017 | Kilickan | D03D 3/08 |
| 2017/0298565 | A1 * | 10/2017 | Eryilmaz | D06L 4/40 |

FOREIGN PATENT DOCUMENTS

| | | |
|---|---|---|
| JP | 2006342436 | 12/2006 |
| WO | 2007052293 | 5/2007 |
| WO | 2008130563 | 10/2008 |
| WO | 2011104022 | 9/2011 |
| WO | 2012062480 | 5/2012 |
| WO | 2015014801 | 2/2015 |

OTHER PUBLICATIONS

International Search report of PCT/EP2017/052466 dated May 11, 2017.
Office Action dated Mar. 2, 2018 for CN patent application No. 201710073684.1.
Office Action dated May 14, 2018 for European Patent application No. 16155105.6.
Office Action dated Oct. 2, 2017 for priority EP application 16155105.6.

* cited by examiner

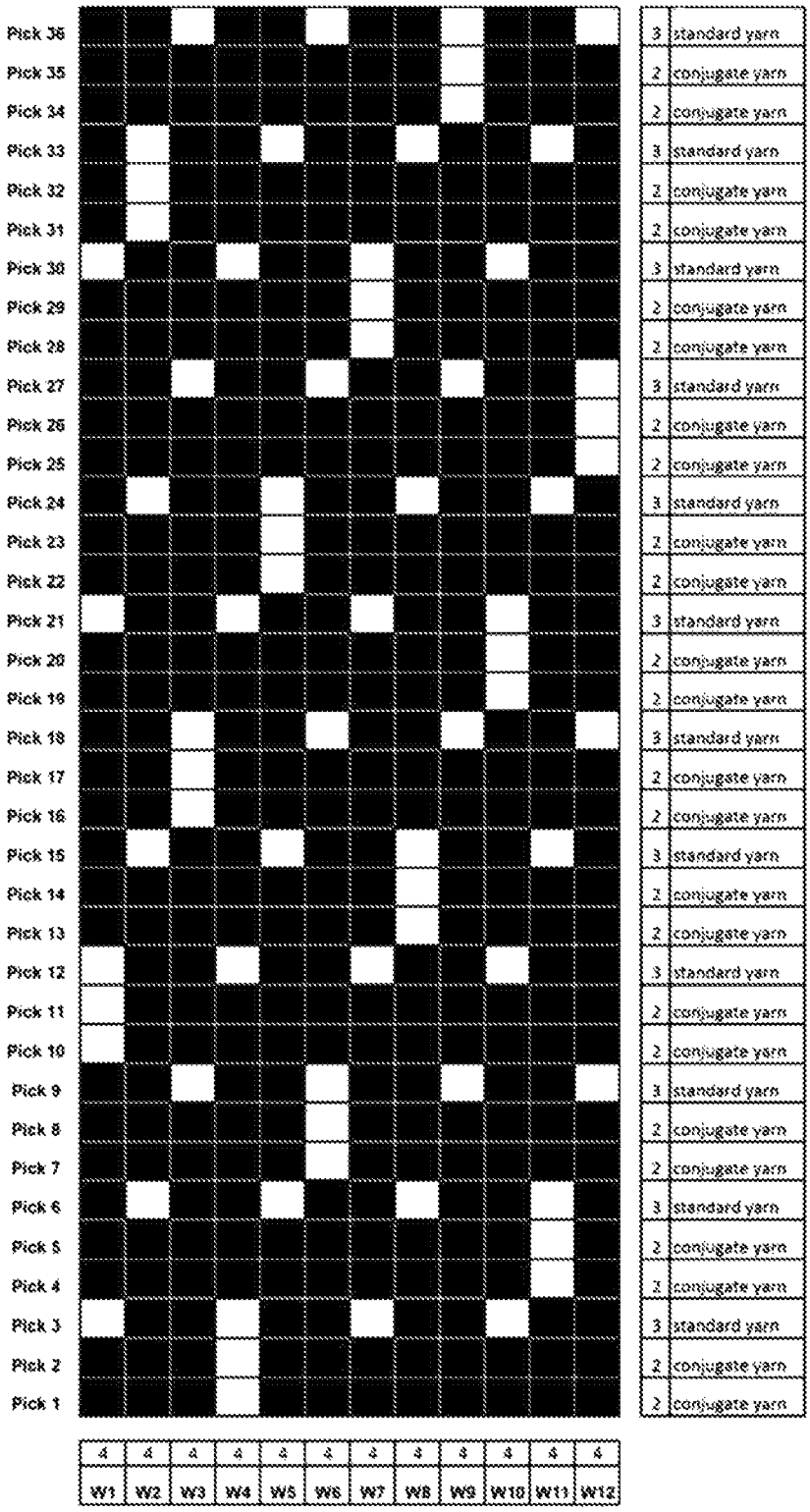
Pick 36
Pick 35
Pick 34
Pick 33
Pick 32
Pick 31
Pick 30
Pick 29
Pick 28
Pick 27
Pick 26
Pick 25
Pick 24
Pick 23
Pick 22
Pick 21
Pick 20
Pick 19
Pick 18
Pick 17
Pick 16
Pick 15
Pick 14
Pick 13
Pick 12
Pick 11
Pick 10
Pick 9
Pick 8
Pick 7
Pick 6
Pick 5
Pick 4
Pick 3
Pick 2
Pick 1
3 standard yarn
2 conjugate yarn
2 conjugate yarn
3 standard yarn
2 conjugate yarn
2 conjugate yarn
3 standard yarn
2 conjugate yarn
2 conjugate yarn

FLEECE FABRIC AND METHOD FOR PRODUCING THE SAME

RELATED APPLICATION

The present application claims priority to European Patent Application No. 16155105.6 filed 10 Feb. 2016 and entitled Fleece Fabric And Method For Producing It, the contents of which are hereby incorporated by reference as if set forth in their entirety.

TECHNICAL FIELD

The present invention relates to a woven fleece fabric, to a process for production of the fleece fabric and to articles made of said fabric.

BACKGROUND

Fleece is a knitted or woven fabric provided on at least one of its sides with thick nap and deep-pile obtained by napping the textile with wire brushes or through a pile weave forming loops that are trimmed. It is typically made of synthetic, mainly polyester, wool or cotton yarns in a plain, pile or knitted weave. The fleece fabrics have insulating air space and are relatively light, so that they are widely used for articles such as blankets, sweaters, hats, jogging bottoms/sweatpants, gym clothes, hoodies, and high-performance outdoor clothing.

However, fleece fabrics have some drawbacks. Fleece is a bulky fabric, due to the deep pile, which makes it suited for only some applications; being bulky, there are problems in handling the fabric, e.g. when garments and articles are made from the fleece fabric. Other problems are the look of the fabric and the fact that the nap (pile) of the fabric eventually wears out.

EP 1925702 discloses a process for preparing a fleece fabric having different kinds of fibers in the front and back faces. The process includes the steps of weaving a natural fiber such as cotton or silk as a ground yarn of the fabric and forming loops in the front face of the fabric by a sinker machine; the tips of the loops are cut to form cut piles that are raised into fibers groups and trimmed. This process is long and expensive and it does not solve the problems of the known art.

WO 2011104022 discloses a process for preparing a woven fabric having the feel and the look of a knitted fabric. The weft yarns include hard yarns and elastomeric yarns both providing warp over portions and under portions. When the fabric shrinks, e.g. at removal from the loom or after washing, the elastomeric yarns shrink more than hard yarn. If the hard yarns' over and/or under portions are long enough (at least 6 adjacent warp yarn), these under/over portions form loops, in a knitted-like manner. A knitted-like fabric can thus be obtained from a woven fabric. WO'022 is silent about fleece fabric.

WO 2015014801 discloses a fabric having a changeable appearance. A woven fabric is provided with weft and warp yarns, providing a base layer for the fabric. A further layer of fabric is formed by the loops of the weft yarn on one side of the fabric. This further layer has no structural functions, and can be easily broken without damaging the base layer of the fabric. As a result, before being broken, the further layer at least partially covers the base layer, providing a first look to the fabric. When the loops of the further layer are broken and possibly removed, the base layer is no longer covered as it was when the loops of the additional layer were intact, thus providing a second appearance to the fabric, different from the first look.

Removal or breaking of the loops only changes the aspect of the fabric, which still maintains the look of a woven fabric. No fleece is disclosed by WO'801.

Therefore, there is a need for a fabric that has a fleece on at least one of its sides and that solves the above-mentioned problems; there also is the need for a process of producing a fleece fabric that is less expensive than the known processes.

SUMMARY

An aim of the present invention is to provide such fleece fabric; another aim is to provide such a process of producing a fleece fabric. These aims are reached by means of the present invention that relates to a fabric, to an article and to a method according to the independent claims. Embodiments are recited in the dependent claims.

According to the invention, there is provided a fabric having a first side and a second side, the fabric comprising weft yarns and warp yarns woven together in pattern, wherein at least some of the weft, or warp, yarns float over a number of warp yarns, or weft yarns, and below a number of warp yarns, or weft yarns, to provide weft, or warp, over portions in said first side and under portions in said second side, whereby said under portions and/or over portions of the yarns provide loops, characterized in that at least some of said yarns providing loops are conjugate yarns comprising a plurality of filaments splittable into a bundle of sub-filaments and in that said loops of the conjugated yarns extend for a length of at least three adjacent warp/weft yarns. In one embodiment, the loops of conjugate yarns are split into sub-filaments and at least part, or all, the sub-filaments are broken to provide a fleece-like surface, or a suede-like surface, according to the length of the sub-filaments.

In greater detail, the invention relates to a fabric, preferably a woven fabric, provided with loops on at least one side of the fabric. The following description will make reference to woven fabric, without this being a limitation to the scope of the invention. The loops in the fabric are made with a conjugate yarn made of, or comprising, a plurality of splittable filaments. In the present description the wording "conjugate yarn" is intended to designate a yarn made of, or comprising, several splittable filaments; a number of splittable filaments are put together, in a known way to form the conjugate yarn. With the wording "splittable filament" it is identified a filament that consists of fine sub-filaments, possibly including a support sub-filament, which are conjugated, i.e. connected, together to provide a one-piece filament.

Usually, a conjugate filament is obtained by co-extrusion of different thermoplastic materials; in some embodiments, a support filament holds all the fine sub-filaments together, in other embodiments the sub-filaments are in a so called side-by-side arrangements; in all embodiments of sub-filaments useful for the present invention, the sub-filaments are temporarily kept together and may be split, partially broken and form the fleece when necessary. The count of the sub-filaments may advantageously be in the range of 0.01 to 0.5 deniers.

Splittable filaments have long been known in the art, see e.g. GB 1016862, and are commonly used to produce non-woven fabrics; exemplary non-woven fabrics can be obtained with machines available on the market e.g. from Reifenhauser or Faré. In the prior art, the filaments are split after being bonded together to increase the volume of the non-woven fabric; a typical use of the thus obtained fabric is in filter technology.

Splitting the filaments, in known art, is carried out without breaking them, i.e. the splitting occurs only to separate the sub-filaments longitudinally to the yarn. In an embodiment of the invention, in addition to the splitting step there is a filament breaking step in which at least a number of the sub-filaments in a yarn are broken, i.e. they are interrupted longitudinally and no longer form a continuous sub-filament throughout the fabric. The breaking, i.e. the interruption, of at least part of the sub-filaments of a yarn is carried out on loops, i.e. over portions or under portions, of the conjugate yarn that are long enough to that purpose.

According to the present invention, a conjugate yarn is woven to provide a fabric together with non-conjugate yarns; the fabric is preferably a woven fabric. Conjugate yarns of splittable filaments are woven weftwise or/and warpwise. In one embodiment conjugate yarns are woven weftwise and the following description will refer to such an embodiment; however, the scope of the invention is not limited to weftwise yarns and includes fabrics in which conjugate yarns are woven as warp yarns (warpwise) or both as warp and as weft yarns. Independently from the direction of the yarns, it is an aspect of the present invention that in the weft (or warp) direction the yarns comprise conjugate yarns and standard yarns, i.e. yarns that are not conjugate yarns. The standard yarns provide the main structure, i.e. the body, of the fabric, the conjugate yarns provide the part of the fabric that, upon breaking at least part of the sub-filaments of the splittable filaments that form the conjugate yarns, will provide the fleece.

In the present application, the wording "fleece" "pile" and "fleece fabric" or "pile fabric" are used to identify a fabric that is obtained by weaving a fabric having conjugated yarns and by splitting and at least partially breaking said yarns into a plurality of sub-filaments, the splitting and breaking is carried out at a plurality of locations of the yarns where the length of the under portion or over portion of the yarn is sufficient to carry out a splitting+breaking step. In some embodiments, the length of the loop is at least 2 mm, or at least 2.5 mm, when measured "on the reed". This means that the length of the loop was at least 2 mm "on the reed", i.e. before removal from the loom, during fabric production. An example of how to calculate the length on reed is as follows. In a fabric that has 5256 warp ends in total there are provided loops that pass over 11 warp ends, the fabric is placed on a reed having length of 1950 mm. In this case, 5256 warp ends are present in 1950 mm, so that the length of a loop "on the reed" passing over 11 warp ends is about 4 mm, i.e. 11/5256*1950 mm. Depending on the loop length, the fleece appearance will change. If the above mentioned loop length is between 2.0-2.5 mm to 3.5 mm, the appearance is more like a suede fabric. A fabric having loops longer than 3.5 mm, will result in having a look that is more like a fleece.

The fleece side, further to its better visual and softness, allows for an improved thermal insulation.

Standard yarns may be alternated to conjugate yarns to provide a ratio of number of standard yarns to number of conjugate yarns in the range of 2:1 to 1:5, inclusive, more advantageously the ratio range is 1:2 to 1:3, i.e. the fabric has 2 to 3 conjugate yarns per standard yarn. In an exemplary embodiment, the weft yarns are alternated to provide a repeating pattern, e.g. there is one standard yarn, two conjugate yarns, one standard yarn, and so on, throughout the fabric.

Standard yarns suitable for the invention are known in the art and commonly used to make fabrics. Standard yarns can be either elastic or substantially non-elastic, in an exemplary embodiment the standard yarn is elastic and the conjugate yarn is non elastic. In an exemplary embodiment, there is a difference in the shrinkage ratio between the standard yarn and the conjugate yarn, in order to provide loops having increased height H, (i.e. an increased distance from the weft/warp yarn over which the loops are floating). In general, the more the standard yarns shrinks at removal from the loom with respect to the conjugate yarn, the greater the height H of the loops is. Loops having greater height are also looser with respect to loops having less height. If otherwise the shrinkage ratio of the standard yarn is substantially similar to the shrinkage ratio of the conjugate yarn, the loops will have less height H. In other words, the height H of the loops is generally a function of the difference between the shrinkage ratio of the standard yarn to the one of the conjugate yarn, higher the difference, higher the loops.

Summarizing, the loops may be "loose" loops or could be adjacent to the fabric; the difference may be expressed by referring to the height of the loop, i.e. to the distance of the apex of the curve from the plane of the fabric. More generally, the difference in the form of the loop is obtained by choosing the elasticity (i.e. the shrinkage ratio) of the standard and of the conjugate yarn. In a loop construction where the loop is a weft yarn passing over (e.g.) 9 warp yarns, when the standard weft yarn and the conjugate weft yarn have the same or a similar elasticity, the loop will be substantially flat. If, the standard yarn is more elastic and therefore shrinks more than the conjugate yarn when removed from the loom and in the finishing processes, the loop formed by the conjugate yarn will be deeper than in the case when both weft yarns have the same shrinking ratio.

Exemplary elastic standard yarns, i.e. yarns that can stretch and that will shrink back once tension is released are commercially available and are disclosed e.g. in WO2008/130563 and in WO 2012/062480. WO2008/130563 discloses elastic yarns having a core made of an inelastic fiber loosely wound around an elastic fiber. WO 2012/062480, in the name of the present applicant Sanko Tekstil, discloses elastic composite yarns having elastic stretchable core and a sheath of inelastic staple fibers; the core is made of an elastic filament and a less elastic filament attached together by coextrusion, intermingling or twisting. The less elastic filament controls the stretch and provides recovery so as to move as a single fiber that has high elasticity and very good recovery properties. As mentioned, even if elastic standard yarn were discussed above, non-elastic standard yarns may also be used.

As a further example, suitable standard yarns are e.g. corespun elastane yarns e.g. with 95% cotton and 5% elastane. Suitable standard yarns may also be other types of yarns, without elastic fibers or components. In other exemplary embodiments, standard yarns are 100% cotton yarns. In general, loops project from at least one side of the fabric to be effectively split and broken, i.e. severed, in a finishing treatment of the fabric or of the garment.

Yarn size of standard yarns may be from Ne 6 to Ne 100 if staple fiber is used; if a filament yarn is used, the size of standard yarns may be in the range of 20 denier to 600 denier. Standard yarn may be either a single yarn or a ply yarn or a twisted yarn, e.g. a Ne 40/2 yarn can be used in embodiments of the present invention. Warp Ne preferably is in the range of 4 to 100; warp yarn could be yarn dyed or greige/undyed. Conjugate yarn size may be in the range from 20 denier to 1800 denier.

The standard yarns form alternately arranged under portions and over portions with respect to said warp yarns in a weave that is tighter than the weave of the conjugate yarns. As known, in a woven fabric, a weft yarn passes alternatively over and under warp yarns. "Over portions" are thus the portion of the standard yarns passing over the warp yarns, and thus "under portions" are the portions of the standard yarn passing under the warp yarns.

In accordance with an exemplary embodiment of the present invention, a woven fabric has a first and a second side and includes a plurality of warp yarns and a plurality of weft yarns woven together in a pattern. As above mentioned, the weft yarns include standard yarns and conjugate yarns, wherein the conjugate yarns have loops that extend on at least one side of the fabric, e.g. the second side. The loops are formed when said conjugate yarns pass a number of warp yarns along the second side of the fabric, the same conjugate yarn will also pass a number of warp yarns when it floats on warp yarns on the first side of the fabric: in the present description, the portions of conjugate yarn on the first side are defined as connection portions. A connection portion may also be intended to provide a support for the loop on the other side of the fabric.

As a result, considering the first side of the fabric as being above the second side of the fabric, the loops of the conjugate yarns are formed by the "under portions" of the conjugate yarns, while the connections portions are formed by the "over portions" of the conjugate yarns. The loops are preferably "loose loops", i.e. they do not completely adhere to the fabric, rather they protrude from it as shown in the attached drawings, thanks to the shrinkage.

For each conjugate yarn, the number of warp yarns passed by the loop is at least 3, and may be in the range of 3 to 24, or in the range of 7 to 15. For each conjugate yarn, the ratio of warp yarns passed by the loops to warp yarns passed by connection portions is between approximate 3:1 and 24:1, or it may be 7/1 to 15/1. As mentioned, in one embodiment the standard yarns are elastic yarns that are woven in a stretched condition so as to provide the loops on the fabric when the fabric is removed from the weaving loom and the fabric shrinks. Further shrinking is obtained during fabric finishing and garment finishing in laundry; if the standard yarns are not elastic, the main shrinking effect for the fabric is obtained during fabric finishing. Warp density before shrinking may be in the range of 20 to 70 warps/cm; after three home washes may be between to 80 warps/cm. In some embodiments, weft density before shrinking is in the range of 20 to 70 weft/cm; after three home washes, weft density is in the range of 25 to 80 weft/cm.

After weaving the fabric with the conjugate yarn, either by chemical or by physical treatments, either in fabric or in garment form, the fine sub-filaments are separated from support filament and numerous fine sub-filaments are released. These fine sub-filaments gives a very soft hand feel. Furthermore, in an exemplary embodiment, at least part of these filaments easily break and the edges come to the top of the surface which gives a sued or fleece kind of look.

According to different embodiments, one side the fabric is provided with the fleece, while the other side can show e.g. natural fibers (cotton, linen, wool, etc.), regenerated fibers (rayon, modal, lyocell), synthetic fibers (nylon, acrylic, etc.), and so on.

It should be noted that, in the prior art, to obtain the above mentioned embodiments, it was necessary to first provide a fleece fabric and then to bond it with another fabric with the desired fiber content and visual aspect. Such a process is complex and expensive. Moreover, for such bonded fabrics, treatments like stone washing, bleaching, garment dying could not be carried out in garment form, since the bonding agent may get affected, i.e. bonded fabrics may become separated one from the other. Moreover, it was known to carry out heavy chemical treatments such as discontinuous treatments (from 30 minutes to 60 minutes) with a bath of NaOH (4 to 30 degrees Baume at around 100° C.) for the separation of the sub-filament. For the fabrics containing fibers such as rayon, wool, modal etc. such a process is very risky. In fact, most of the fibers which undergo the above mentioned process show a loss of strength (or possibly they are dissolved). If a fabric (e.g. a cotton fabric) with indigo dyed warp and conjugate yarn is subjected to such heavy treatments, the cotton yarns and fibers are likely to be damaged and, most of all, such long treatments may result in creases on the fabric where the fabric is bent during treatment and also loss of indigo may occur because indigo will bleed in such long treatments.

A further advantage of the present invention is in the fact that it is easy to obtain a woven fabric having fleece on (at least) one side, and having a high specific surface area. According to an aspect of the present invention, the specific surface area of the fabric is at least 80 $m^2/g$, according to the BET surface area test, and it may advantageously be higher than 100 $m^2/g$. This values are higher than regular fabrics.

This aspect shows various advantages. As an example, a fabric according to the invention may be used to provide anti-allergic effect. In more detail, it is known that e.g. mites, in the form of their excrement, and dust can be responsible for discomfort for the user, especially the ones suffering from allergies. The presence of thick (i.e. dense) fleece on (at least) one side of the fabric forms a barrier for mites and allergens, so they do not easily pass through on the fabric, and it is comfortable against the skin of a user. As an example, such a fabric may be effectively used e.g. as a cover for mattresses or pillows, providing an anti-allergic effect, while being comfortable.

Furthermore, according to an exemplary embodiment, the fabric according to one or more of the preceding aspects, in particular fabrics having a high specific surface area value, can be effectively used to produce garments that allow delivering of a cosmetic and/or drug to a user. In particular, drugs and/or cosmetics can be stored on the fabric surface (i.e. on the "fleeced" side) through microencapsulation, and subsequently delivered to the skin of a user. In particular, microcapsules can contain various types of cosmetic compounds and these microcapsules are attached to the fabric. During use, these compounds will be released to the skin of a user wearing the present fabric either by breakage or diffusion, which may occur e.g. when reaching a predetermined temperature, pH or mechanical pressure. A high surface area such as the fleece side of the fabric of the invention, allows to store a high number of microcapsules, increasing the storage capacity of a fabric, and thus its capacity to deliver to the skin of a user a high amount of compound.

In addition, fleeced fabric according to embodiments of the present invention provide high specific surface area so as to enhance and accelerate the biological growth of metabolites of organisms used as biocoating, such as bacterial cellulose and collagen microfibrils. As before, a high surface area provides a greater place for bacteria and microorganisms, thus promoting the above mentioned growth.

In a further embodiment conjugate yarns are conductive yarns and/or may comprise conductive fibers. When conductive materials are used in the conjugate yarn to form the fleeced side, thanks to the high specific surface area, better ohmic contact is established on the fleeced side. Thanks to this, as an example, electronic signals between a fabric and a user can be exchanged with high efficiency.

Mechanical treatments such as brushing, emerizing, etc., are usually applied to fabrics to achieve fleece or sued type of looks. But these traditional techniques have some limitations and considerations.

For instance, the elastane could be damaged or even broken during these processes. Not only corespun elastane, but also elastane intermingled yarns are under risk. The process according to the present invention provides the advantage that the conjugate yarn will cover the surface to be mechanically treated and the standard yarn will be protected and elastane will not break. A further advantage is that thanks to this invention, the fleece formation is very natural and equal on all over of the fabric.

Still another advantage of the invention is that brushing step in fabric form could be avoided. For instance, in jeans of denim fabric, the fleece formation could be obtained directly when the jeans are being treated in laundry. During these treatments, such as stone washing, enzyme washing, bleaching etcetera, thanks to the friction in the bath, the filaments will split and the sub-filaments will break to provide a fleece. Thus, a separate brushing step of the fabric will be not be necessary; this will of course positively influence the cost of the final product.

When the fabric construction of the present invention is made following the weaving pattern object of above discussed WO'022, the resulting fabric has a knit fabric feeling and "hand", the look, i.e. the appearance, of a knit fabric and also a side, usually the internal side of the garment, that is provided with a fleece effect.

BRIEF DESCRIPTION OF THE DRAWINGS

The present invention is best understood from the following detailed description when read in conjunction with the accompanying non limiting drawing. It is emphasized that, according to common practice, the various features of the drawing are not necessarily to scale. On the contrary, the dimensions of the various features are arbitrarily expanded or reduced for clarity. Like numerals denote like features throughout the specification and drawing.

FIGS. 5-9 are weaving reports of fabrics according to an embodiment of the invention.

DETAILED DESCRIPTION

Figure 1:
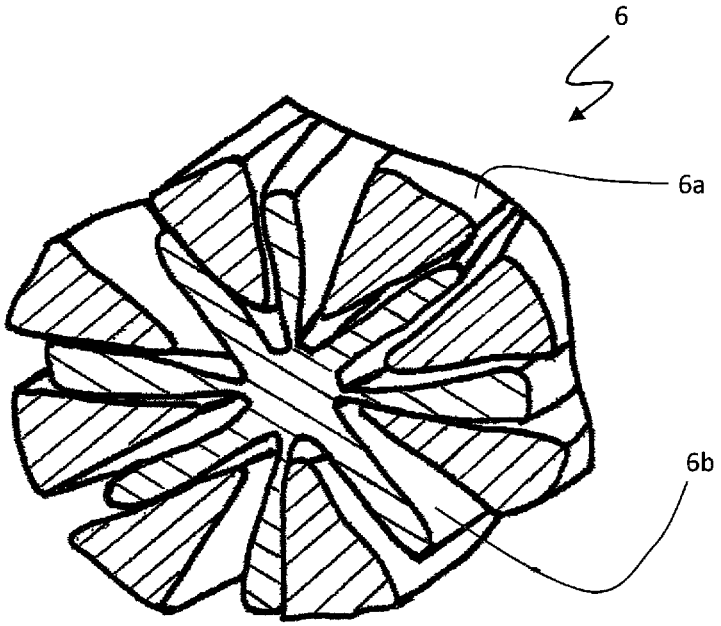
FIG. 1 and FIG. 2 are a view of a section of a splittable filament of a conjugate yarn suitable for the invention.

With reference to FIGS. 1-4B, a fabric 1 is provided with a first side 1*a* and with a second side 1*b*. The fabric 1 comprises weft yarns 2, 3 and warp yarns 4 woven together in pattern.

At least some of the weft yarns 2, 3 float over a number of warp yarns 4 to provide over portions 2*a*, 3*a* in the first side 1*a*, and below a number of warp yarns 4 to provide under portions 2*b*, 3*b* in the second side 1*b*. The under portions and/or the over portions of the yarns provide loops.

Advantageously, at least some of the yarns providing loops are conjugate yarns 2. As above discussed, in the shown embodiment conjugate yarns 2 are part of the weft yarns 2, 3. However, embodiments are possible wherein the warp yarn forms under portions and/or over portions providing loops, and wherein part of these warp yarn loops are conjugate yarn.

Conjugate yarns 2 are yarns made of, or they comprise, several splittable filaments 6. As discussed, after weaving the fabric 1 or after making a garment, splittable filaments 6 of the loops 5 of the conjugate yarns 2 (from now on also referred as "loops 5") are split into sub-filaments and broken so as to provide the above mentioned fleece look to the fabric.

Figure 2:
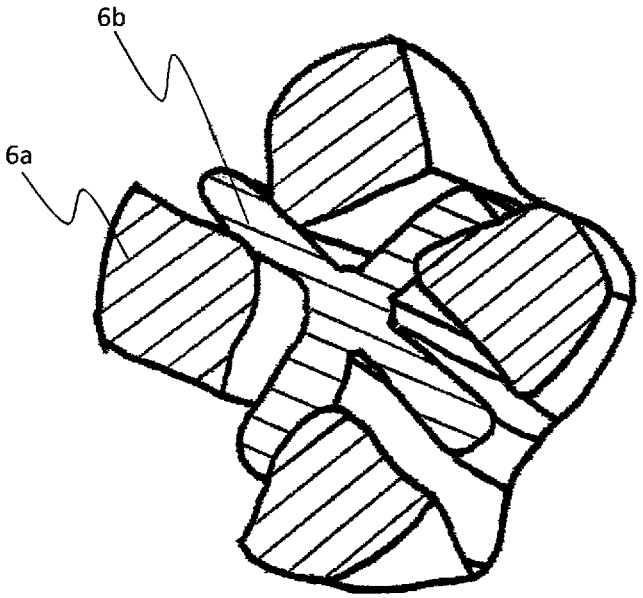

A splittable filament 6 according to an exemplary embodiment of the invention is shown in FIG. 1. A further splittable filament 6 according to another embodiment is shown in FIG. 2, where the same numeric references are used for similar elements.

In general, the splittable filaments 6 consist of fine sub-filaments 6*a* and 6*b*. Typically, one or more of the sub-filaments 6*a*, 6*b* may have higher mechanical properties than the other sub-filaments, and are used to support the other sub-filaments. From now on, for greater clarity of the description, the supported sub-filaments will be referred to as "sub-filament(s) 6*a*", while the sub-filaments supporting the weaker sub-filaments will be referred as "support sub-filament(s) 6*b*". The sub-filaments 6*a* and the support sub-filament 6*b* are co-extruded together in the co-extrusion step in a way known in the art. Typically, as per the shown embodiment, the sub-filaments 6*a* and the support sub-filament 6*b* are co-extruded according to an arrangement known in the art as "splittable pie". Other known arrangements are however possible, as an example the ones shown in FIGS. 2A-2F. Also other arrangements, not shown in the figures, can be used with the present invention, i.e. the section of the splittable filaments of the conjugate yarn according to some other embodiments of the present invention different from the ones of FIGS. 2A-2F.

Figure 2A:
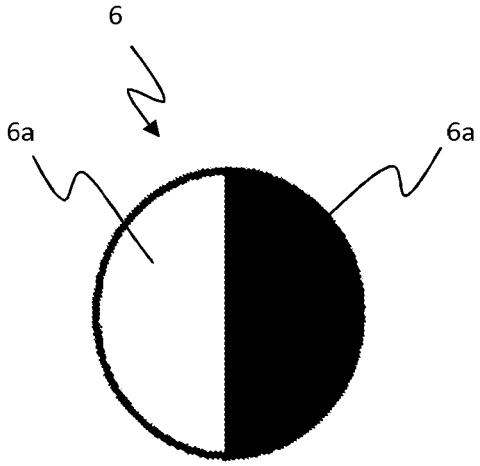
FIGS. 2A-2F are schematic views of other embodiments of a splittable filament of a conjugate yarn suitable for the invention.
Figure 2B:
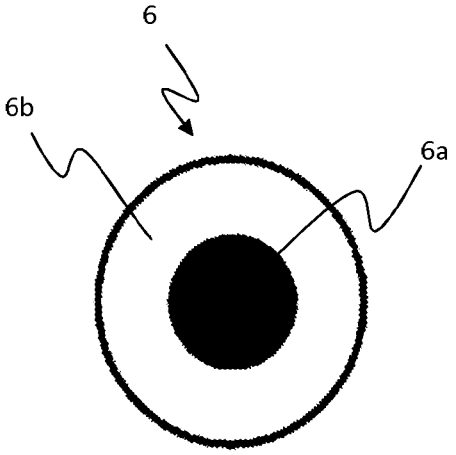
Figure 2C:
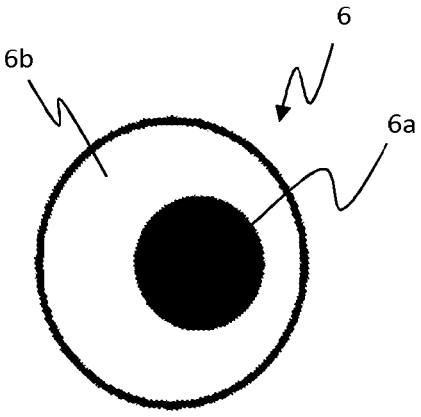
Figure 2D:
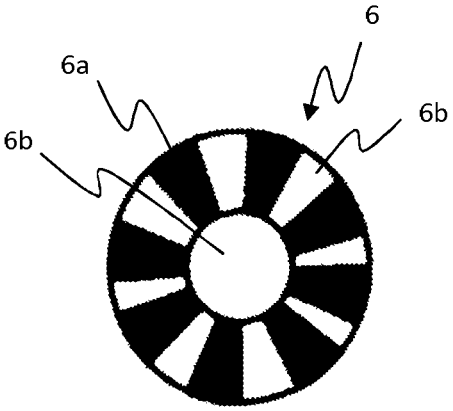
Figure 2E:
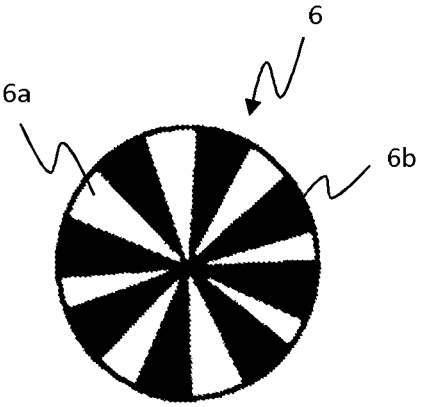
Figure 2F:
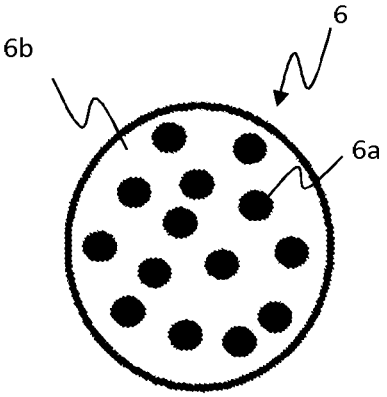
Figure 3:
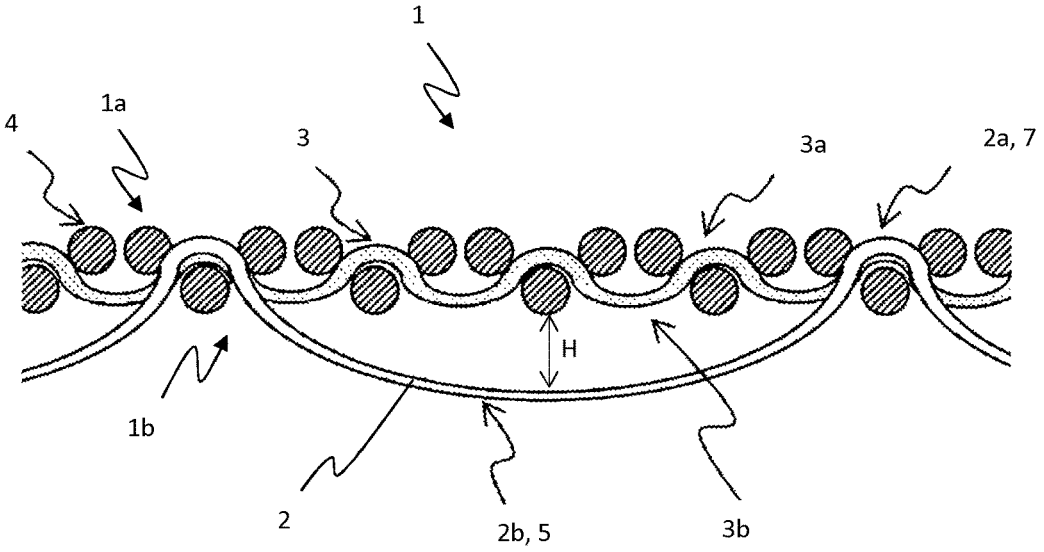
FIG. 3 is a schematic sectional view of an exemplary embodiment of a fabric suitable for the invention.

In FIG. 2A a side-by-side arrangement is shown, where two sub-filaments 6*a* are placed one next to the other. In FIGS. 2B and 2C core-sheath arrangement are shown, wherein a sub-filament 6*a* is enclosed within a support filament 6*b*. The sub filament 6*a* may be coaxial with respect to the support filament 6*b* (as per FIG. 2A) or eccentric with respect to the latter (as per FIG. 2C). In FIG. 2D a "hollow center pie" arrangement is shown, which is similar to the one of FIG. 2. In FIG. 2E a "splittable pie" configuration is shown, wherein a plurality of sub-filaments 6*a* (possibly different one to the other) are placed one next to the other to form a filament of a closed section (typically substantially circular). In FIG. 2F a "island in a sea" configuration is shown, wherein a plurality of sub-filaments 6*a* are placed within a support filament wherein the splittable filament 6 is provided with a closed hollow section. Possibly a support filament 6*b* may be inserted within the splittable filament 6 of the present embodiment.

Different material can be used for the different parts of conjugate yarn 2, such as polyester, nylon, viscose, lyocell, acrylic fibers, polypropylene, etc. Non-compatible materials are advantageously used for the different portions to prepare splittable filaments 6 so as to enhance the splitting step; examples of non-compatible materials are e.g. polyamides co-extruded with polyesters.

In various embodiments, fine sub-filament 6*a* has count comprised between 0.01 and 0.5 denier.

According to different embodiments, a splittable filament 6 may comprise a number of sub-filaments 6*a* between 3 and 100.

The embodiment of FIG. 1 has eight sub-filaments 6*a* and a central or support sub-filament 6*b*, while in the embodiment of FIG. 2, four sub-filaments 6*a* and a support sub-filament 6*b* are shown. In general, a plurality of splittable filaments 6 are grouped together into a conjugate yarn 2, so that the count of a conjugate yarn 2 may be between 200 den and 1800) den. According to an aspect, conjugate yarns 2 can be obtained from staple fiber or from filament fiber. Conjugate yarns 2 can be of any color (or color combination) desired.

In various embodiments, conjugate yarns 2 can be twisted, texturized, intermingled with elastane or used with an outer support filament, e.g. conjugate yarn could be intermingled with 20 denier polyester as a supporting yarn, so basically conjugate yarn could be produced with any type of the yarn production method in staple or filament form as long as there are enough filaments that can be split into sub-filaments to provide a "fleece" effect.

According to exemplary embodiments, splittable filament 6 can be bi-component, and/or it can be provided with sub-filaments 6*a* having different shrinkage characteristics, and/or it can be provided with sub-filaments 6*a* having crimps, as known e.g. from previously cited prior art.

An exemplary embodiment of conjugate yarn 2 will be now disclosed with reference to FIG. 1. FIG. 1 shows a cross-section of a polyester/nylon splittable filament 6. In this exemplary embodiment, nylon is used for the support filament 6*b*, which creates the body of the splittable filament. The fine sub-filaments 6*a* are polyester based. In particular, there are 8 fine polyester sub-filaments in the core of each splittable conjugate filaments. Composition of the splittable filament 6 is 70% polyester 30% nylon. The cross-section of the filament 6 is of the splittable pie type. 72 splittable filaments 6 form a conjugate yarn 2. Size of the conjugate yarn 2 is 150 denier. As a result, the average count of each splittable filament 6 is about 2 den (150 denier divided by 72 is equal to 2.083 den). As 70% in composition is polyester, the total polyester part will be 70% of 2,083, i.e. 1.45 denier. Considering that each splittable conjugate filament contains 8 fine sub-filament 6*a*, the average count of each fine sub-filament 6*a* is around 0.18 (i.e 1.45 denier divided by 8). Considering that the conventional micro polyester fineness is around 0.5 denier per filament, the sub-filaments 6*a* of the present embodiment are about 65% finer than conventional polyester filaments. As a result, the present sub-filament 6*a* is softer and weaker in terms of strength and can easily break or rupture to provide the required fleece on the side of the fabric where the loops are located.

According to an exemplary embodiment, the weft yarns comprise standard yarns 3 in addition to conjugate yarns 2. The "standard yarn" can be any suitable non-conjugate yarn that can be coupled to the warp yarn. The standard yarns 3 and the conjugate yarns 2 are arranged in a predetermined arrangement, in some embodiments advantageously comprising at least one conjugate yarn 2 alternately arranged with at least one standard yarn 3.

According to one embodiment, the standard yarn 3 has a greater shrinkage ratio than conjugate yarn 2, when measured with the same test. Suitable apparatuses for measuring the shrinkage ratio are known in the art, e.g. an Uster Tensorapid tester (Uster, CH) can be used to determine the shrinkage ratio. In any case, standard yarns and conjugate yarns having substantially the same shrinkage can be used, e.g. conjugate yarns and standard yarns both comprising elastane.

In exemplary embodiments standard yarns may be substantially elastic or substantially non-elastic. In some embodiments, the ratio of standard yarns 3 to conjugate yarns 2 (i.e. between the number of the standard yarns and the number of the conjugate yarns) is between 2:1 and 1:5, inclusive. The average ratio of standard yarns 3 to conjugate yarns 2 may advantageously be between 1:2 and 1:3, inclusive. Furthermore, the characteristics of the standard and/or of the conjugate yarns and the ratio of standard yarns 3 to conjugate yarns 2 need not be regular, or the same throughout the fabric; namely designs may be obtained by using different weft yarns, conjugate and/or standard, in different ratios in different areas.

As mentioned, the weave of the fabric 1 is such that the conjugate yarns 2 form loops 5; loops 5 can be obtained in different ways known in the art. As an example, the above mentioned difference in the shrinkage ratio may help to create deeper loops. However, loops 5 can be formed even without such a difference.

In general, when the completed fabric 1 is removed from the weaving loom, i.e. when the fabric is no longer under tension, the fabric will shrink (typically by at least 10% with respect to its original dimension, depending on the construction) so that the under portions 2*b*, 3*b* and/or over portions 2*a*, 3*a* provide a plurality of loops on the back of the fabric. Shrinking may be favored by using elastic standard yarns of the type previously discussed; however, loops may be formed also without elastic standard yarns through natural shrinkage that occurs, possibly helped by washing either in fabric or in garment form.

The average number of adjacent warp yarns 4 passed by each loop 5 is at least 3, and it may vary within the range of 3 to 24; the number of warp yarns 4 passed by each loop 5 need not to be the same for all loops 5. It is not strictly necessary that every single loop 5 pass at least three warp yarns 4. Provided that for each conjugate yarn 2 the average number of warp yarns 4 passed by each loop 5 is at least three, the number of warp yarns 4 passed by individual loops 5 can vary without deviating from the inventive concept, as would be known to one skilled in the art.

The weaving construction may provide for loops of different lengths, e.g. the loops of a first conjugate weft yarn float over three warp yarns, while the loops of another conjugate weft yarn float over 5 warp yarns. In general, wider loops 5 provide longer broken protruding sub-filament 6*a*, 6*b* and thus a stronger "fleece effect".

All the loops 5 may advantageously be arranged on the same side of the fabric 1, so as to obtain a fabric having a fleece on one side; in another exemplary embodiment the loops (and the resulting fleece) are provided on both sides of the fabric. As an example, with reference to the embodiment shown in FIGS. 3 and 4, loops 5 are formed when the conjugate yarns 2 pass a number of warp yarns 4 along the second side 1*b* of the fabric. The same conjugate yarn 2 will also pass a number of warp yarns when it floats on warp yarns 4 on the first side of the fabric: in the present description, the portions of conjugate yarn on the first side are defined as connection portions 7. A connection portion 7 is typically intended to provide a support for the loop on the other side of the fabric. Connection portions 7 float over a reduced number of warp yarns 4 with respect to the loops 5.

According to an embodiment, the ratio of warp yarns 4 passed by loop 5 to warp yarns 4 passed by connection portions 7 is between approximately 3:1 and 24:1, inclusive. The standard yarns 3 may form alternately arranged under portions 3*b* and over portions 3*a* with respect to said warp yarns 4 in the weave. These under portions 3*b* and over portions 3*a* form a weave with respect to the warp yarns 4 that is tighter than the weave formed by the conjugate yarns 2. The weave patterns of FIGS. 5-10 show various embodiments of the present invention.

According to exemplary embodiments, loops 5 of the conjugate yarns 2 are created such that they are in substantially less tension than under portions 3*b* and over portions 3*a* created by standard yarns 3.

In exemplary embodiments, the warp density after weaving but before shrinking is between approximately 20 and 70 warp yarns per centimeter, inclusive. After treatment of the fabric and after three home washes, the warp density may advantageously be between approximately 25 and 80 warp yarns per centimeter, inclusive. Home washes are carried out at 60° C. followed by drying and the last wash and dry is followed by a conditioning step for 8 hours; these tests are usual in the art and reference to ASTM D 3776/96 and to BS 63302A is made for said tests.

It is even more preferred that the warp density after weaving but before shrinking be between approximately 25 and 60 warp yarns per centimeter, inclusive, and between approximately 30 and 65 warp yarns per centimeter after three home washes. The warp density may be between approximately 30 and 50 warp yarns per centimeter, inclusive, after weaving but before shrinking, and between approximately 35 and 55 warp yarns per centimeter after three home washes. Generally, the warp and weft density measurements are made at 65% humidity, ±5%, and 20° C., ±2° C.

Similar to the warp density, exemplary embodiments can also define weft densities. It is preferred that after weaving, but before shrinking, the weft density should be between approximately 20 and 70 weft yarns per centimeter, inclusive. After three home washes it is preferred that the weft density be between approximately 25 and 88 wefts per centimeter, inclusive. In various embodiments, it is more preferred that after weaving, but before shrinking, the weft density be between approximately 30 and 60 wefts per centimeter, inclusive. After three home washings, it is more preferred that the weft density be between approximately 38 and 75 wefts per centimeter, inclusive. It is even more preferred that after weaving but before shrinking, the weft density be between 35 and 55 wefts per centimeter, inclusive, and between approximately 44 and 68 wefts per centimeter, inclusive, after three home washes.

In a further exemplary embodiment of the present invention, the warp yarns have an English cotton number between approximately Ne 4 and Ne 100, inclusive.

Similarly, in another exemplary embodiment of the present invention, the standard yarns 3 are made from filament yarn and have a denier between approximately 20 and 600 denier, inclusive. In another exemplary embodiment, the standard yarns 3 are made from staple fibers in the range between approximately Ne 6 and Ne 100 inclusive. As mentioned before, the conjugate yarns 2 have a count comprised between approximately 20 and 1800 den, inclusive, or a count between 75 to 600, or between 150 to 450, in various embodiments.

Weaving reports of exemplary embodiments are shown in FIGS. 5-10. According to various embodiments, the weaving report is configured so that the loops 5 of the conjugate yarns 2 are always protruding from the warp yarns 4 more than the under/over portions 3*a*, 3*b* (according to the side of the fabric 1 where the loops 5 are provided) of the standard yarn 3. Thanks to this, especially when applying a mechanical treatment to the fabric, all, or most of the stress is applied to the loops 5 of the conjugate yarn 2, so as to provide a better splitting/breakage of the loops 5, and thus a good "fleece effect".

More in detail, in some embodiments, a particularly good fleece effect is obtained if the length of the loops 5 (i.e. the number warp yarns over which the loops float over) is greater than the length of the under/over portions of the standard yarns 3 that are provided on the same side of the fabric of the loops (i.e. the under portions 3*b*, in the shown embodiment). If the length of the loops 5 and/or of the under/over portion is not constant in the weaving report, it is advantageous that the length of the loops 5 is greater than the length of the under/over portions of the standard yarns that are placed adjacent (i.e. immediately above or immediately below in the shown embodiments) to the conjugate yarn 2 providing the loops 5. In one advantageous embodiment, the loops are at least 1.5 times longer than the under/over portions of the standard yarns 3.

The configuration of the weave report may also help to provide a particularly good fleece effect. According to an embodiment, the connection portions 7 are placed at the under/over portions 3*a*-3*b* (i.e. the ones on the same side of the connection portions 7) of a standard yarn 3 that is adjacent to the conjugate yarns. In other words, on the side of the fabric that is opposite to the side of the loops 5, the connection portions 7 of a conjugate yarn pass over the same warp yarn 4 that is passed over by the under/over portion of a standard yarn 3, i.e. the portions of a standard yarn 3 placed on the same side of the connection portions 7 (which, in the shown embodiment, are the over portions 3*a*), that is adjacent to the conjugate yarn 2. Connection portions 7 may also pass over a warp yarn 4 that is near the warp yarn 4 that is passed over by the under/over portion of a standard yarn 3 adjacent to the conjugate yarn 2. The expressions "near" and "at" varies according to the length of the loops 5 and of the standard yarns 3. Preferably the distance implied by "near" and "at" is less than two warp yarns 4.

Figure 6:
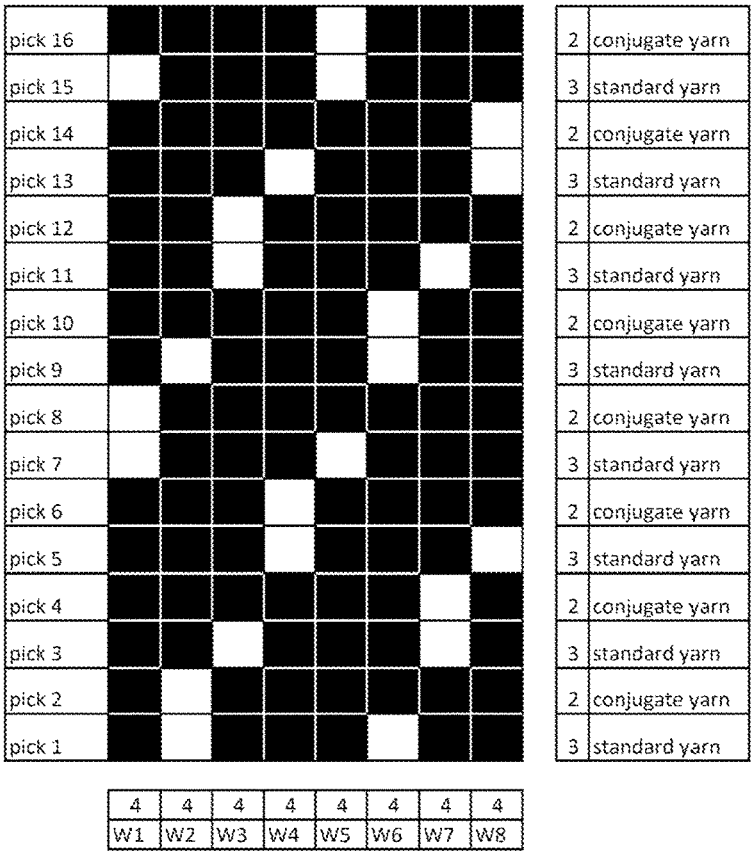
Figure 7:
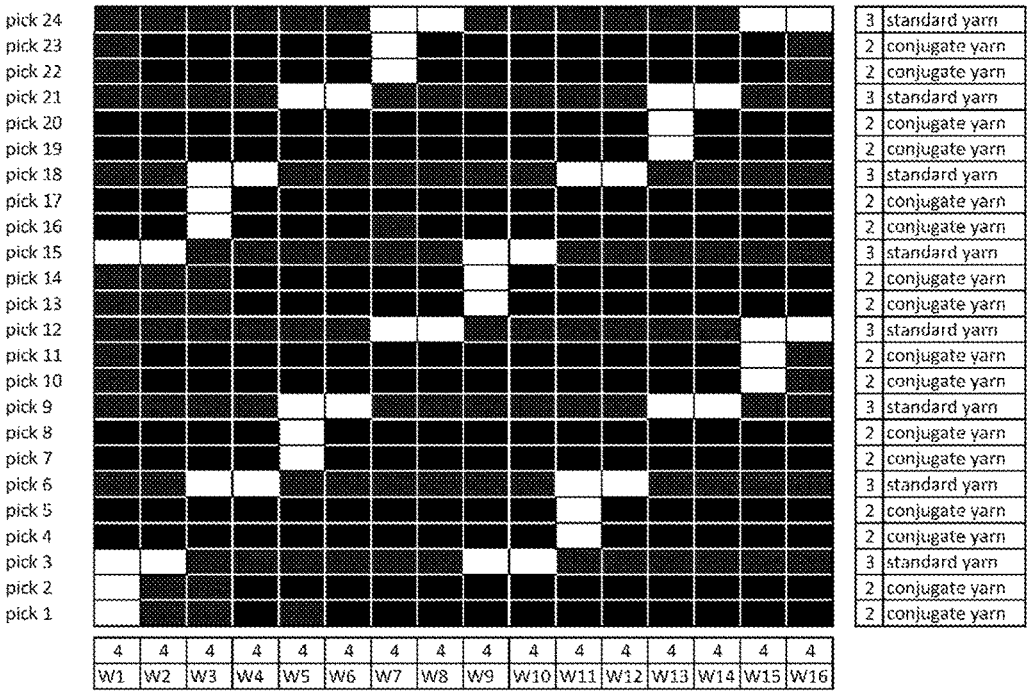
Figure 8:
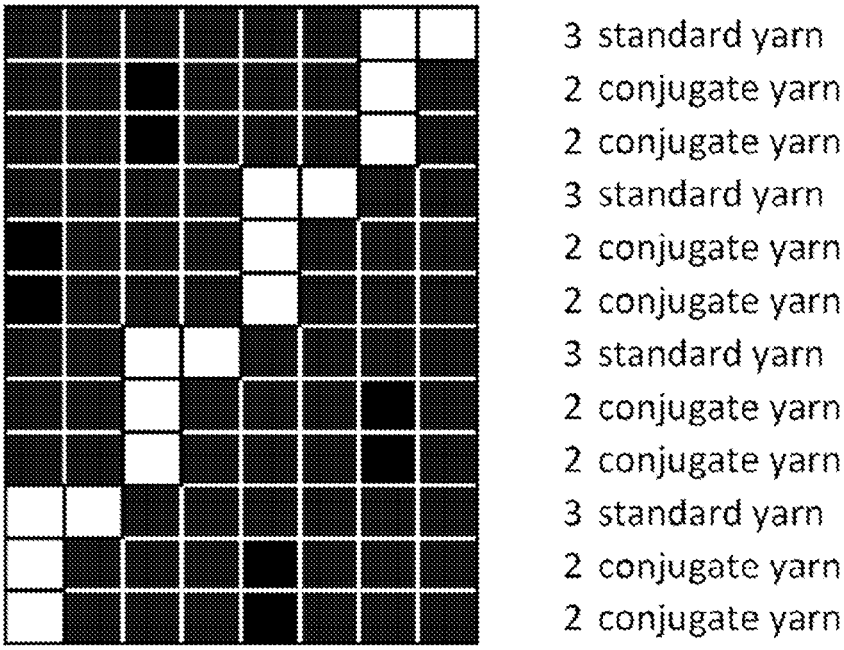
Figure 9:
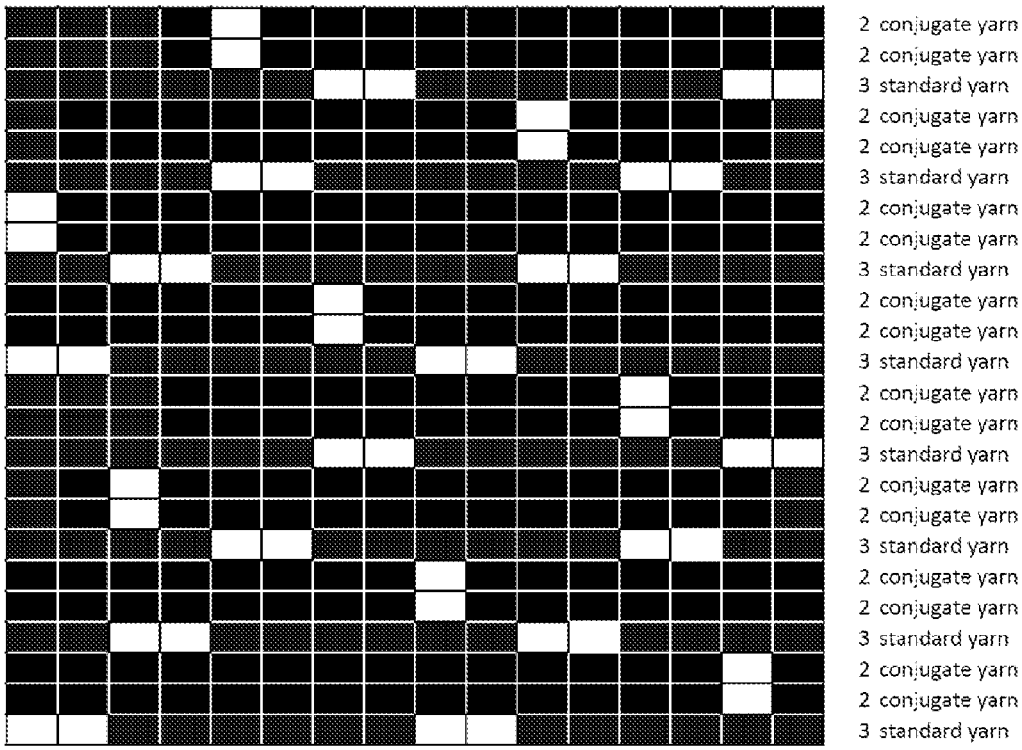
Figure 10:
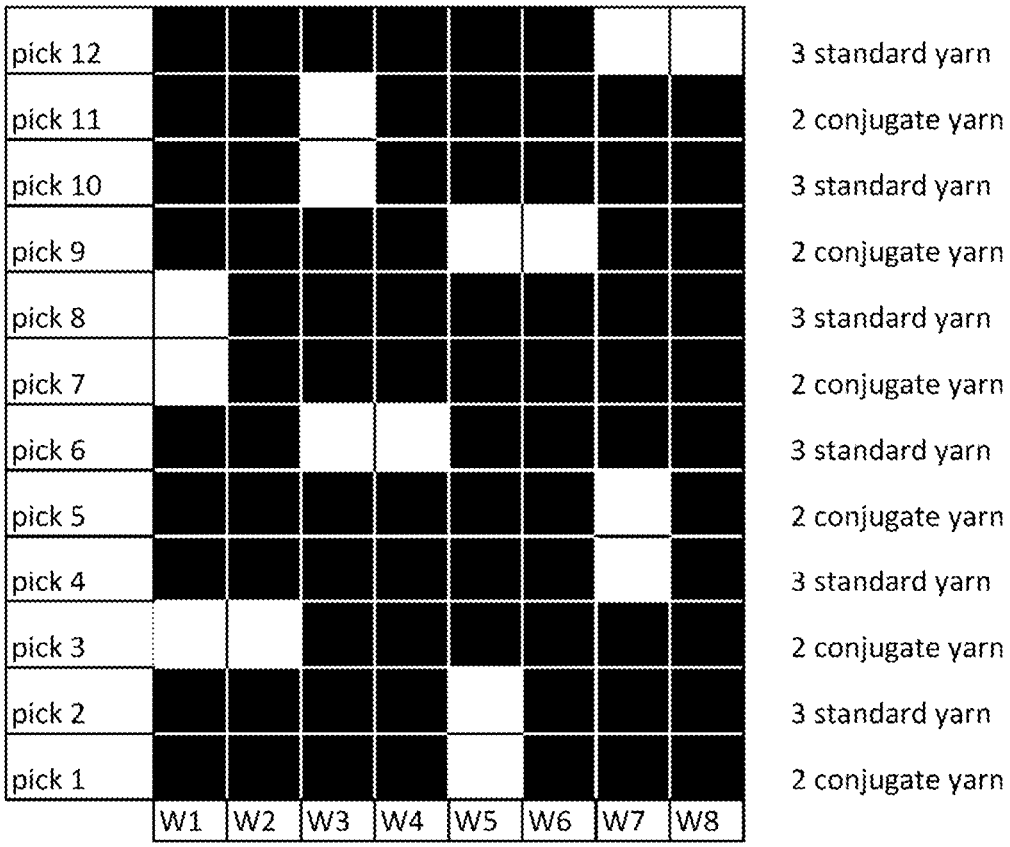
FIG. 10 is a weaving report according to a further embodiment of the invention.

With reference to the drawings:

- in the embodiments of FIG. 5-7, the length of the loops of the conjugate yarn 2 is greater than the length of the under portions of the standard yarn 3, and also the connection portions 7 are placed at the over portions of the adjacent yarn. In particular, in FIG. 5 the length of the loops is 5.5 times the length of the under portions 3*b*, in FIG. 6 the loops 5 are 2.3 times the under portion 3*b*, in FIG. 7 the loops 5 are 2.5 times the under portions 3*b*. The fleece effect is particularly good.
- in the embodiment of FIG. 8, the loops 5 of the conjugate yarn 2 are longer than the under portions of the standard yarn 3, and also connection portions 7 are placed at the over portions of the adjacent yarn. In particular, the length of the loops 5 is 1.17 times the length of the under portions 3*b*. The fleece effect is good.
- in the embodiment of FIG. 9, the length of the loops of the conjugate yarn 2 is much greater than (i.e. it is 2.5) the length of the under portions of the standard yarn, and the connection portions 7 are not placed at the over portions of the adjacent yarn. The fleece effect is good.
- in the embodiment of FIG. 10, the loops 5 of the conjugate yarn 2 are longer than (i.e. 1.17 times) the under portions of the standard yarn 3, and the connection portions 7 are not placed at the over portions of the adjacent standard yarn. The fleece effect is acceptable/good.

After weaving the fabric 1 with the above mentioned loops 5, a fleece may then be provided. In particular, the filaments 6 of at least part of the loops 5 are split, so that at least part of the sub-filaments 6*a* separate one from the other and from the support filament 6*b*, if present; the sub-filaments are then broken, i.e. severed, so that each sub-filament provides two parts of sub-filament that protrude from the fabric, namely from the connection portion 7 between two adjacent loops.

This operation can be carried out stressing the fabric 1 according to various methods. The fabric 1 may be subject to chemical or physical treatments in order to separate the sub-filaments 6*a*, and possibly also the support filament 6*b*, to break at least part of them; abrasion is one advantageous physical treatment. As an example, stone washing can be used in garment form. It was found that 60 minutes of stone-washing in ambient water may be sufficient to split the sub-filaments. Also, in some embodiments, washing is performed without stones and in this case separation of the sub-filaments 6*a* is caused by friction of fabric on fabric. Longer loops are easier to break and provide a greater fleece effect.

In general, various methods can be used, that impart a stress on the fabric that is suitable to separate the sub-filaments 6*a*, without substantially damaging the other parts of fabric 1.

Broken sub-filaments 6*a* provide for the above mentioned "fleece effect".

According to an embodiment, thanks to the loop arrangement, separation of the sub-filaments can be carried out substantially at ambient temperature. On the contrary, in the known art sub-filaments 6*a*, 6*b* were separated by means of complex chemical treatments, typically involving high temperatures. As a result, the known method caused a high waste of energy and they were also time consuming. Furthermore, further physical treatments such as brushing or emerizing were needed to complete the separation step. These treatments may damage the fabric.

On the contrary, simple and safe treatments can be used according to the present embodiments to separate the sub-filaments 6*a*, 6*b* (i.e. to split the splittable filament 6) and to break the separated sub-filament to provide a fleece construction. As mentioned, the splitting step of the process is preferably carried out on the garment obtained from (or including the) fabric according to the invention. This step may be carried out together with the "stoning" step, i.e. the step carried out to provide the garment with a "used" or worn-out look.

Separation and breakage of the filaments 6 present in loops 5 into sub-filaments 6*a*, 6*b* can be performed in garment form by suitable processes such as chemical treatments, thermal treatments, mechanical treatments. As an example, the separation and breakage of the filaments can be obtained by means of at least one process selected from the following non limiting list of examples: stone washing, perlite washing, sand blasting, hand-scraping, laser treatments, bleaching, caustic-shrinking washing, enzyme biostoning, abrasion on dry fabric.

If the treatment is mechanical (like stone washing, hand scraping, etc.), the treatment may advantageously be applied to the side of the garment where the loops 5 are, thus making the above mentioned separation easier and faster. For instance, if a denim fabric is designed with "reverse side" loops of the conjugate yarns 2, i.e. loops placed on the side of the fabric that is arranged so as to be directed towards the user (i.e. the reverse side), a pair of jeans obtained from such a fabric can be stone washed for 1 hour to obtain the fleece effect in a non-reversed condition (i.e. in the "traditional" form).

However, if the jeans are stone washed in the reverse condition (i.e. in the "inside out" form, with the reverse side exposed), the same fleece effect can be achieved with the same stone washing treatment, in only 30 minutes. This is not so relevant for the chemical treatments like caustic shrinking treatment or enzyme washing.

It has to be noted that none of the above mentioned easy and not-aggressive treatments will allow a fleece effect on a fabric designed with the same yarns of the present invention but lacking the loops 5 of the conjugate yarn. It should be also noted that the above mentioned separation step can be performed before tailoring the fabric, but also when the fabric 1 is already in garment form. In other words, a garment may be created from the fabric 1, having the sub-filaments in non-separate form (i.e. with the loops 5 unbroken) in various embodiments. After a garment or an article, is created from fabric 1, the garment can be stressed to cause separation of the sub-filaments. As mentioned, when the sub-filaments are separated, a fleece can be obtained. In more detail, the sub-filaments are very fine, so that they are easily broken; the broken sub-filaments 6*a* create edges on top of the fabric surface, thus providing a fleece.

According to a previously discussed embodiment, the loops 5 may be arranged only on one side of the fabric 1. As a result, the sides 1*a*, 1*b* of the fabric 1 can have look and feel very different from one another. As an example, in the shown embodiment, loops 5 are arranged on the second side 1*b* of the fabric 1. As a result, after separating the sub-filaments 6*b* of the loops 5, the second side 1*b* will show a fleece look and feel. On the contrary, the first side 1*a* is not provided with loops 5, and the fleece is not obtained on the first side 1*a*.

According to the yarns and the weaving pattern, a fabric 1 can thus have a fleece side (second side 1*b* in the shown embodiment) and the first side 1*a* can be e.g. a denim. Denim for the "non-fleece" side is an advantageous embodiment, but other solutions can be employed, e.g. gabardine, chamber, etc.

In general, different embodiments provide that on one side the fabric is of the fleece type, while the other side can show e.g. natural fibers (cotton, linen, wool, etc.), regenerated fibers (rayon, modal, lyocell), synthetic fibers (nylon, acrylic, etc), and so on.

In general, according to the weaving pattern, the first side 1*a* (or in general the side not provided with loops 5) can be provided with the desired visual effects, while the second side 1*b* (or in general the side provided with loops 5) can be fleece. In some embodiments, the first side has a denim appearance.

According to another embodiment, both the sides 1*a* and 1*b* of the fabric 1 are provided with loops 5, so that fleece look and feel can be obtained on both sides 1*a*, 1*b* of the fabric.

In view of the above, a method of making a fabric according to an exemplary embodiment will be now discussed.

The first step of the process is providing warp yarns 4. The step can include selecting a thickness of the yarns, as well as the warp density. Other aspects of the warp yarns, known to those skilled in the art, can also be determined at this step. It will often be the case that this step will include the selection of indigo dyed warp yarns. The use of indigo dyed warp yarns will allow the resulting fabric to take advantage of many of the unique aspects of the indigo dyeing process.

A further step provides for weft yarns 2, 3. In particular, part of said weft yarns are conjugate yarns 2, i.e. splittable yarns that are made by a plurality of sub-filaments that separate from each other and that break upon being stressed; the remaining yarns are standard yarns, i.e. yarns that do not break under the same stress that is applied to the conjugate yarns; standard yarns provide a structure for the fabric after the conjugate yarns have been split into sub-filaments and the sub-filaments are broken. Similar to what discussed above, this step can include determining all the aspects of the weft yarns known to those skilled in the art, including but not limited to: the thickness of the yarns, shrinkage ratio, elasticity, color, weft density, etc.

Conjugate yarns 2 form loops 5. In particular, according to an embodiment, conjugate yarns 2 are alternately arranged with standard yarns 3, ensuring that the conjugate yarns 2 form a series of over portions 2*a* and under portions 2*b*. After weaving, the fabric 1 is removed from the loom and during the finishing treatments, the fabric shrinks because tension on yarns is removed. The conjugate yarns form thus loops 5 on (at least) one side of the fabric. According to an embodiment, as discussed above, the standard yarns can be elastic, core-spun elastic yarns. According to this embodiment, after weaving higher fabric shrinkage will be obtained therefore higher loop height and easier fleece formation will be achieved.

It should be noted that shrinking naturally occurs as soon as the fabric is removed from the weaving loom and the yarns are no longer under tension; further shrinking occurs by wetting the fabric, during the processes. According to an embodiment, the fabric 1 is tailored into an article, typically a garment, the garment is preferably a clothing article such as pants, jeans, shirts, sweaters, jackets and any other garment. A preferred fabric is denim or denim-looking fabric, the preferred garments are garments having a side with a denim-look or a jeans-look and the other side having a fleece layer, i.e. the fleece is provided on one side of the garment. Preferably, the fleece side of the denim garment is the internal side of the garment. Subsequently, the article is processed in order to separate the sub-filaments 6*a* of the splittable filament 6 of the loops 5. According to another embodiment, the sub-filaments 6*a* are separated before tailoring the fabric into an article.

In general, the sub-filaments are separated by carrying out on the fabric or on the article physical or chemical treatments that allow separation of the sub-filaments 6*a* (possibly of support sub-filament(s) 6*b*, too) without damaging or substantially damaging the fabric 1.

Figure 4A:
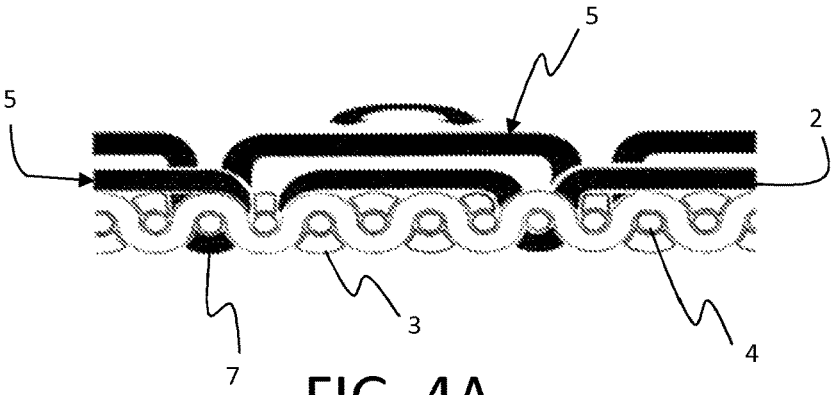
FIGS. 4A and 4B are schematic views of an exemplary embodiment of a fabric before the splitting and breaking step and after the splitting and breaking step respectively.
Figure 4B:
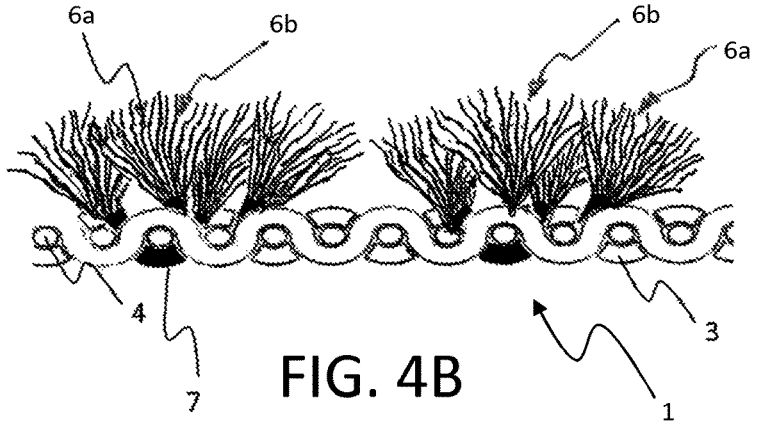

As previously discussed, the size of sub-filaments 6*a* is preferably in the range of 0.01 den to 0.5 den, i.e. the sub-filaments are so fine that they are easily broken; sub-filaments are broken in the same treatment that provides separation of the conjugate yarn into sub-filaments or in a subsequent step. As a result of breaking the sub-filaments a plurality of short and fine stubs of sub-filaments 6*a*, 6*b* are formed, protruding from the structure of fabric 1 (formed by the warp yarns and the standard yarns) so as to provide a fleece. This condition of the fabric is schematically shown in FIG. 4B for a fleece provided on one side of the fabric; as previously mentioned, the same construction may be obtained on both sides of the fabric.

The invention will now be further disclosed with reference to the following non-limiting examples of woven fabrics.

Example 1

The warp yarns, weft yarns, warp density, weft density and loom set-up were chosen according to the values in Table 1. These selections gave the resulting fabric a weight of approximately 10-11 oz/sqyd (335-375 g/cm$^2$). The weave pattern was selected according to the weave report depicted in FIG. 5. A dobby-type weaving loom with a weft selection system was used to perform the weaving.

After weaving, the fabric was wetted and stretched in the length (warp) direction. When this happens, the fabric shrinks in the width (weft) direction, the elastic yarn pulling the warp yarns together. Because the conjugate weft yarns are not elastic, they do not shrink as much as the standard weft yarns used in this example, and the conjugate yarn floats on the one side of the fabric forming loops which cover most of the back side of the fabric; all the loops have the same length, the length of the loops was about 4 mm.

After shrinking, the fabric was subjected to a sanforizing treatment to reduce shrinking in further garment washings. The indigo warp yarns gave the warp side fabric the look and qualities of a denim fabric, such as denim's ability to take on finishing effects, such as abrasion effects.

The fabric was cut and sewn into an article, namely a pair of track suit bottoms having an inner side provided with the loops; the article thus obtained was then stone washed for 30 minutes at 40° C., in the reverse ("inside out") form.

At the end of the stone washing step, the side of the fabric previously provided with the loops was covered by a fleece white in color due to the un-dyed sub-filaments of the conjugate yarns, and was extremely soft due to the very fine count of the sub-filaments obtained by splitting the conjugate filaments. The fleece also prevents the indigo from the warp yarns coming into contact with the skin of a person wearing the garment, preventing the indigo dye from running if the person sweats.

Due at least in part to the selection of the weave and standard weft yarns, the resulting fabric had very high elastic properties. These properties included the ability to stretch in all directions, not just the weft direction.

Example 2

The warp yarns, weft yarns, warp density, weft density and loom set-up were chosen according to the values in Table 1. The weave pattern was selected according to the weave report depicted in FIG. 6. Examination of the weave report shows that the ratio of standard-yarns to conjugate yarns is 1:1, as opposed to 1:2 in Example 1. The ratio between the length of the loops 5 to the length of the under portions of the standard yarns is 7/3, i.e. about 2.

The fabric was used to make an article, namely a pair of skinny jeans having an inner side provided with the loops; the jeans were stone washed after exposing the inner side so as to be abraded in the stone washing process. At the end of the stone washing step, the side of the fabric previously provided with the loops was covered by a black fleece in color due to the color of the sub-filaments of the conjugate yarns, and extremely soft due to the very fine count of the sub-filaments obtained by splitting the conjugate filaments.

Example 3

The warp yarns, weft yarns, warp density, weft density and loom set-up were chosen according to the values in Table 1. The weave pattern was selected according to the weave report depicted in FIG. 7. Examination of the weave report shows that the ratio of standard yarns to conjugate yarns is 1:2, as per Example 1. The ratio between the length of the loops 5 to the length of the under portions 3*b* of the standard yarn is 15/6. i.e. 2.5. Furthermore, the over portions of the standard yarn float over two warp yarns, while the connection portions 7 of the conjugate yarns 2 float over 1 warp yarn which are adjacent warp yarns.

The fabric was used to make an article, namely a jacket with fleece having an inner side provided with the loops; the jacket was stone washed after exposing the inner side so as to be abraded in the stone washing process. At the end of the stone washing step, the side of the fabric previously provided with the loops was covered by a heather/melange fleece in color due to the color of the sub-filaments of the conjugate yarns, and extremely soft due to the very fine count of the sub-filaments obtained by splitting the conjugate filaments.

The following table 1 summarizes the characteristics of the above examples.

TABLE 1

| Sample | Warp Yarn | Standard Weft Yarn | Conjugate Weft Yarn | Warp Density | Weft Density | Fabric Weight | Warps passed by "Loop" Portion |
|---|---|---|---|---|---|---|---|
| Example 1 | Ne 20/1 Ring spun 100% cotton, indigo dyed yarn | 70 Denier polyester + 40 Denier Lycra (with 3, 5 draft ratio) intermingled yarn | 150 denier/ 72 filament textured and soft intermingle white yarn | 27 ends/cm in weaving reed | 42 picks/cm in loom state fabric, 48 picks/cm finished fabric | 10-12 oz/ sqyd | 11 |
| Example 2 | 14/1 ring spun, slubby 100% cotton, indigo dyed yarn | 24/1 elastic standard yarn. | 150 denier/ 72 filament textured and soft intermingled black yarn | 25 ends/cm in weaving reed | 42 picks/cm in loom state fabric. 49 picks/cm at the finished fabric. | 10-12 oz/ sqyd | 7 |
| Example 3 | 14/1 ring spun, slubby 100% cotton, indigo dyed yarn | 20/1 elastic standard yarn. | 150 denier/ 72 filament textured and soft intermingled heather/melange yarn | 23 ends/cm in weaving reed | 37 picks/cm in loom state fabric. 43 picks/cm at the finished fabric | 11-13 oz | 15 |

As the sub-filaments are very fine and weak, after the fleece formation, pilling will not be a problem because the fiber balls will fall of the surface as they are not strong enough so the pilling test results are better than the fabric made with a conventional yarn which has a coarser denier.

The fabrics of the above mentioned examples were all subjected to a pilling drum test with machine MS P18A, after the loops are formed but before a fleece is obtained, i.e. the fabric is in the normal (filaments not split) condition. As known, this test method shows how the fabric reacts when it is subjected to friction with itself. Basically small cylinders are covered with fabric subjected to the test and put inside a drum, whose inside is also covered with the fabric. The drum is rotated for a certain time with a certain speed to provide the above mentioned friction. A good fleece effect is obtained when the result of the test is smaller than 3. The above mentioned result is evaluated by means of visual inspection by an operator, who compares the specimen with reference images. The fabrics of examples 1, 2 and 3 showed a result smaller than 2.

The following example shows the improvement in thermal and air permeability properties of the fabric according to the invention.

Example 4

As an example, a standard fabric according to WO 2011104022, was prepared following the weaving pattern of FIG. 5, in this fabric the weft yarns making loops were standard yarns made of cotton.

The same fabric (according to FIG. 5 weaving pattern) was prepared according to the present invention, i.e. with conjugate yarn loops instead of cotton loops which are transformed into fleece by at least partly separating and breaking the fine sub-filaments.

The two kinds of fabric were tested according to test EN ISO 1109:2014 (to measure thermal resistance) and according to test DIN EN ISO 9237:1995-12[A], on a test apparatus TEXTEST FX 3300 (to measure air permeability). The result of the two tests are shown in Table 2. Performance of the fabric according to the invention was sensibly better than standard fabric, i.e. it showed an increase of about 75% in thermal resistance and a decrease of about 70% in air permeability with respect to the above mentioned standard fabric. As mentioned, both fabrics were produced by using the same weaving report and the same standard and warp yarns.

TABLE 2

| Fabric | Thermal resistance ($m^2K/W$) | Air permeability (mm/s) |
|---|---|---|
| Standard | 0.028 | 238.0 |
| Example 4 | 0.049 | 72.1 |

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A fabric having a first side and a second side, the fabric comprising weft yarns and warp yarns woven together in pattern, wherein at least some of the weft, or warp, yarns float over a plurality of warp yarns, or weft yarns, and below a plurality of warp yarns, or weft yarns, to provide weft, or warp, over portions on said first side and weft, or warp under portions on said second side, whereby at least one of said under portions and said over portions of the yarns form loops, wherein at least some of said yarns that form said loops are conjugate yarns comprising a plurality of filaments splittable into sub-filaments, and said loops of said conjugate yarns extend for a length of at least three adjacent warp, or weft, yarns, wherein said under portions form said loops and said over portions define connection portions and said loops extend past a first number of yarns and the connection portions extend past a second number of yarns, the first number being at least 3 times the second number and less than 24 times the second number.

2. The fabric according to claim 1, wherein at least part of said sub-filaments of the loops are separate from each other and at least some of said sub-filaments are broken to provide a plurality of loose ends protruding from a body of the fabric and forming a fleece layer.

3. The fabric according to claim 1, wherein said conjugate yarn has a count comprising between about 75 and 600 den.

4. The fabric according to claim 1, wherein said sub-filaments include a count between 0.01 and 0.5 den.

5. The fabric according to claim 1, wherein said splittable filaments comprise between 3 and 100 said sub-filaments.

6. The fabric according to claim 1, wherein some of said weft yarns are elastic.

7. The fabric according to claim 1, wherein said conjugate yarns extend in a first direction and a ratio of said conjugate yarn to other ones of said weft or warp yarns extending in said first direction, lies between 5:1 and 1:2.

8. The fabric according to claim 1, wherein at least one of a warp density and a weft density is between approximately 25 and 80 warps/cm after three home washes.

9. The fabric according to claim 1, herein said fabric is a denim fabric.

10. The fabric according to claim 9, wherein said denim fabric includes said first side having a denim appearance and said second side being a fleece layer.

11. The fabric according to claim 1, wherein said warp yarns have an English cotton number between approximately Ne 4 and Ne100.

12. The fabric according to claim 1, wherein said loops are on said first side of said fabric and on said second side of said fabric, said conjugate yarns pass over a weft yarn or a warp yarn, and further yarns adjacent to said conjugate yarns pass over the same weft or warp yarn passed over by the conjugate yarn, or a weft or warp yarn that is adjacent to the weft or warp yarn passed over by the conjugate yarn.

13. The fabric according to claim, 1, wherein a length of the loops of said conjugate yarns is at least 1.5 times greater than a length of said under or over portions of other ones of said yarns.

14. The fabric according to claim 1, wherein said conjugate yarn has a count comprising between about 20 and 1800 den.

15. A method for producing a fabric, the method comprising:

providing warp yarns;

providing weft yarns, wherein at least one of: at least some of said warp yarns are conjugate yarns; and, at least some of said weft yarns are said conjugate yarns, said conjugate yarns comprising a plurality of filaments splittable into a bundle of sub-filaments and said conjugate yarns including under portions and over portions with respect to said warp or weft yarns; and forming loops with one of said under portions and said over portions of said conjugate yarns, and forming connection portions with the other of said under portion and said over portions of said conjugate yarns, said loops extend past a first number of weft or warp yarns and the connection portions extend past a second number of weft or warp yarns, the first number being at least 3 times the second number and less than 24 times the second number.

16. The method according to claim 15, further comprising:

splitting at least part of said filaments into said sub-filaments; and breaking apart at least part of said sub-filaments to form fleece.

17. The method according to claim 16, further comprising tailoring said fabric into a garment after said splitting.

18. The method according to claim 17, wherein said conjugate yarns are weft yarns and said weft yarns include further weft yarns.

19. The method according to claim 16, wherein at least one of said splitting and said breaking apart is carried out by a process selected from the group consisting of: stone washing, perlite washing, sand blasting, hand-scraping, laser treatments, bleaching, caustic-shrinking washing, enzyme biostoning, chemical treatments, thermal treatments, mechanical treatments, and abrasion on fabric.

20. An article comprising a fabric having a first side and a second side, the fabric comprising weft yarns and warp yarns woven together in pattern, wherein at least some of the weft, or warp, yarns float over a plurality of warp yarns, or weft yarns, and below a plurality of warp yarns, or weft yarns, to provide weft, or warp, over portions on said first side and weft, or warp under portions on said second side, wherein at least one of said under portions and said over of the yarns form loops and at least some of said yarns that form said loops are conjugate yarns comprising a plurality of filaments splittable into sub-filaments, and said loops of said conjugate yarns extend for a length of at least three adjacent warp, or weft yarns, wherein said under portions form said loops and said over portions define connection portions and said loops extend past a first number of yarns and the connection portions extend past a second number of yarns, the first number being at least 3 times the second number and less than 24 times the second number, said article comprising a garment.

21. The article according to claim 20, wherein said fabric is a denim fabric that includes said first side having a denim appearance and said second side being a fleece layer and said garment comprise one of pants, jeans, a shirt, a sweater, a jacket and track suit bottoms.

* * * * *